US005622268A

United States Patent [19]

Conner et al.

[11] Patent Number: 5,622,268

[45] Date of Patent: Apr. 22, 1997

[54] APPARATUS FOR CALIPERING A COLLATED ASSEMBLAGE

[75] Inventors: Charles J. Conner, Dayton; Douglas P. Loughman, Brookville; David U. Johnson, Dayton, all of Ohio

[73] Assignee: Heidelberg Finishing Systems, Inc., Dayton, Ohio

[21] Appl. No.: 347,266

[22] Filed: Nov. 30, 1994

[51] Int. Cl.[6] ..... B07C 5/12; B65H 7/02; B65H 39/00

[52] U.S. Cl. ..... 209/603; 209/587; 209/900; 270/52.26; 100/99; 271/265.04; 356/381

[58] Field of Search ..... 209/559, 565, 209/579, 587, 600, 601, 602, 603, 604, 938, 900; 271/262, 263, 265.04; 270/52.14, 58.01, 52.26; 356/381, 382; 250/559.27, 560; 501/127, 153; 100/47, 99, 169

[56] References Cited

U.S. PATENT DOCUMENTS

| | | | |
|---|---|---|---|
| 3,246,496 | 4/1966 | Holben | 100/99 X |
| 4,121,716 | 10/1978 | Luperti et al. | 209/603 X |
| 4,170,346 | 10/1979 | Murray et al. | 270/52.04 X |
| 4,576,287 | 3/1986 | Bingham et al. | 271/262 X |
| 4,657,198 | 4/1987 | Shimizu et al. | 250/559.27 X |
| 4,748,331 | 5/1988 | Nagao et al. | 356/381 X |
| 4,778,167 | 10/1988 | Snow et al. | 270/52.04 X |
| 4,848,864 | 7/1989 | Ostertag et al. | 250/235 X |
| 4,994,678 | 2/1991 | Sasaki | 356/381 X |
| 5,061,337 | 10/1991 | Fraser | 100/47 X |
| 5,119,311 | 6/1992 | Gold et al. | 100/99 X |

FOREIGN PATENT DOCUMENTS

| | | | |
|---|---|---|---|
| 0650100 | 4/1995 | European Pat. Off. . | |
| 2152843 | 6/1990 | Japan | 271/262 |

*Primary Examiner*—William E. Terrell
*Assistant Examiner*—Tuan Nguyen
*Attorney, Agent, or Firm*—Tarolli, Sundheim, Covell, Tummino & Szabo

[57] ABSTRACT

An apparatus (10) comprises a movable member (60) having an outer circumferential surface which engages a collated assemblage (20) on a collating conveyor (14) to compress the collated assemblage when the member is moved towards the collated assemblage. A light source (36) directs light (37) toward the outer circumferential surface of the member. The outer circumferential surface includes a light reflective surface (83) portion against which the light is directed and then reflected. The reflected light (38) has a characteristic which varies as a function of the thickness of the collated assemblage. The reflected light is sensed and a first electrical signal (42) is provided which varies as a function of the characteristic of the reflected light and thus as a function of the thickness of the collated assemblage. An electrical circuit (90) detects a value of the first electrical signal corresponding to a maximum compressed condition of the collated assemblage, holds the value for at least a predetermined time period, and provides a second electrical signal (96, 97) indicative of whether the value of the first electrical signal is within a predetermined value range.

11 Claims, 4 Drawing Sheets

APPARATUS FOR CALIPERING A COLLATED ASSEMBLAGE

TECHNICAL FIELD

The present invention relates to a collator for forming collated assemblages on a collating conveyor, and particularly relates to an apparatus for calipering a collated assemblage on a collating conveyor.

BACKGROUND ART

Calipering devices for measuring the thickness of a collated assemblage on a collating conveyor are known. Some calipering devices compress the pages of a collated assemblage to be measured before a sensor is triggered to take a measurement which is indicative of the number of pages of the collated assemblage. The collated assemblage is compressed to remove fluff from the collated assemblage so that the sensor can provide an accurate output signal indicative of the number of pages of the collated assemblage.

A problem associated with some known calipering devices is the effect of mechanical vibration on the output signal of the sensor which is indicative of the number of pages of the collated assemblage being measured. The collated assemblage may not be in a desired compressed condition when mechanical vibration is present and the sensor is triggered to take a measurement. If the collated assemblage is not in a desired compressed condition when the sensor is triggered to take a measurement, the output signal provided by the sensor may not accurately indicate the number of pages of the collated assemblage.

SUMMARY OF THE INVENTION

In accordance with the present invention, an apparatus is provided for use along a collating conveyor having collated assemblages thereon. The apparatus comprises compressing means which compresses a collated assemblage. Sensing means senses the thickness of a compressed collated assemblage and provides a first electrical signal which varies as a function of the thickness of the compressed collated assemblage. Circuit means detects a value of the first electrical signal corresponding to a maximum compressed condition of the collated assemblage. The circuit means also holds the value of the first electrical signal corresponding to a maximum compressed condition of the collated assemblage for at least a predetermined time period. The circuit means further provides a second electrical signal indicative of whether the value of the first electrical signal is within a predetermined value range.

Preferably, the circuit means includes a peak detector circuit which detects the largest peak value of the first electrical signal which corresponds to the maximum compressed condition of the collated assemblage. The circuit means includes a delay timer circuit which resets the peak detector circuit after the peak detector circuit has held the largest peak value of the first electrical signal for at least the predetermined time period. The circuit means includes a processing circuit which determines whether the value of the first electrical signal is within the predetermined value range and provides the second electrical signal.

BRIEF DESCRIPTION OF THE DRAWINGS

The foregoing and other features of the present invention will become apparent to one skilled in the art to which the present invention relates upon consideration of the following description of the invention with reference to the accompanying drawings, wherein.

DESCRIPTION OF PREFERRED EMBODIMENT

The present invention is directed to a calipering assembly for use along a collating line. The specific construction and use of the calipering assembly may vary. By way of example, a calipering assembly constructed in accordance with the present invention is embodied in a saddle binding line which forms collated assemblages along a collating conveyor chain.

Figure 1:
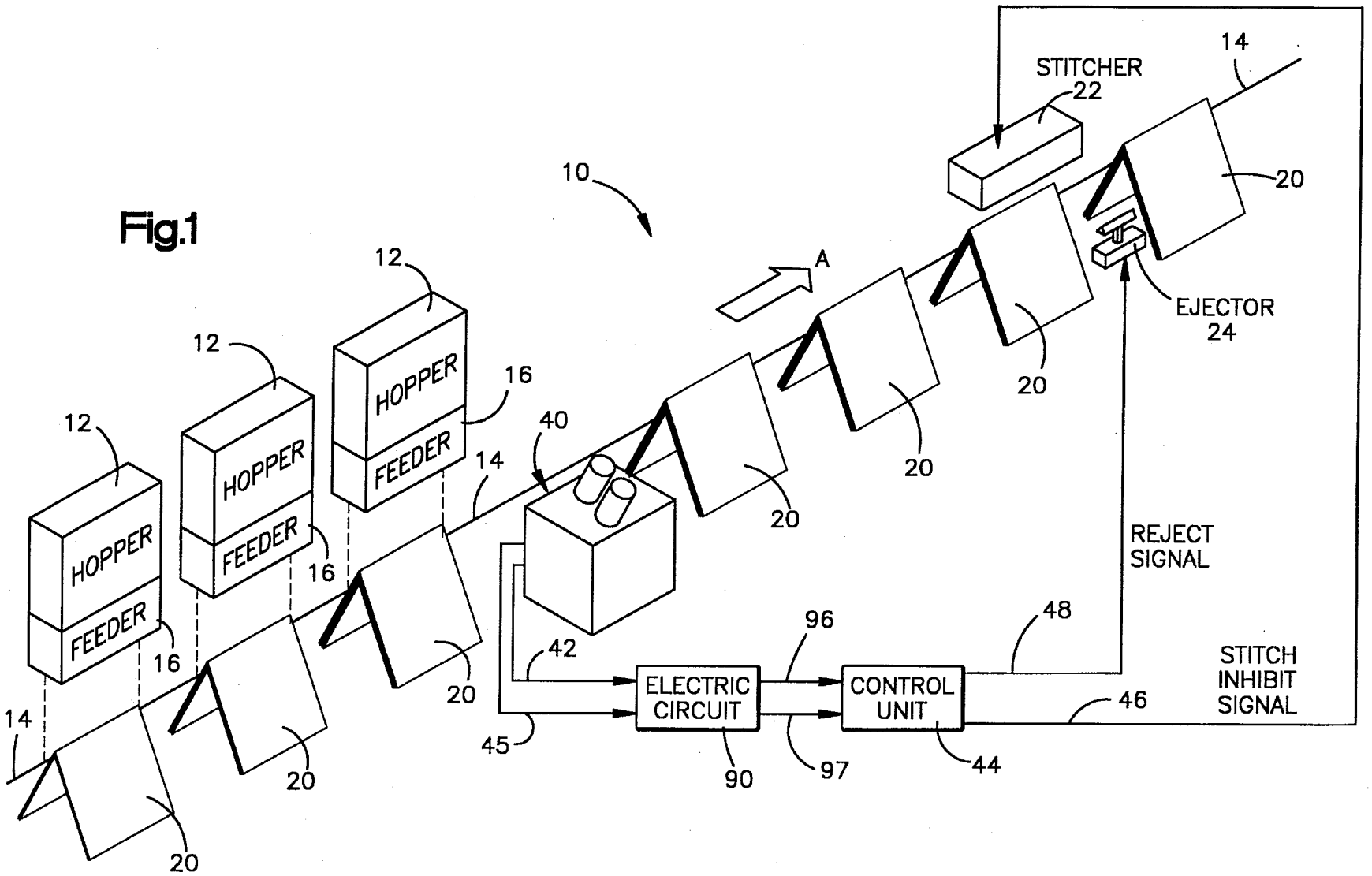
FIG. 1 is a schematic diagram of a collating line incorporating a calipering assembly constructed in accordance with the present invention.

Referring to FIG. 1, a typical saddle binding line 10 includes a plurality of hoppers 12 which store signatures and a collating conveyor chain 14 which is movable past the hoppers 12. A plurality of feeders 16 are operatively connected to the hoppers 12 to feed signatures from the hoppers 12 onto the conveyor chain 14 to form collated assemblages 20 on the conveyor chain 14. The number of feeders is equal to the number of hoppers. Each feeder is associated with a respective hopper. The conveyor chain 14 carries the collated assemblages 20 in a sequence at regularly spaced intervals to a stitcher 22. An ejector 24 is located downstream of the stitcher 22. The direction of flow of the collated assemblages 20 is indicated by the arrow A.

Figure 2:
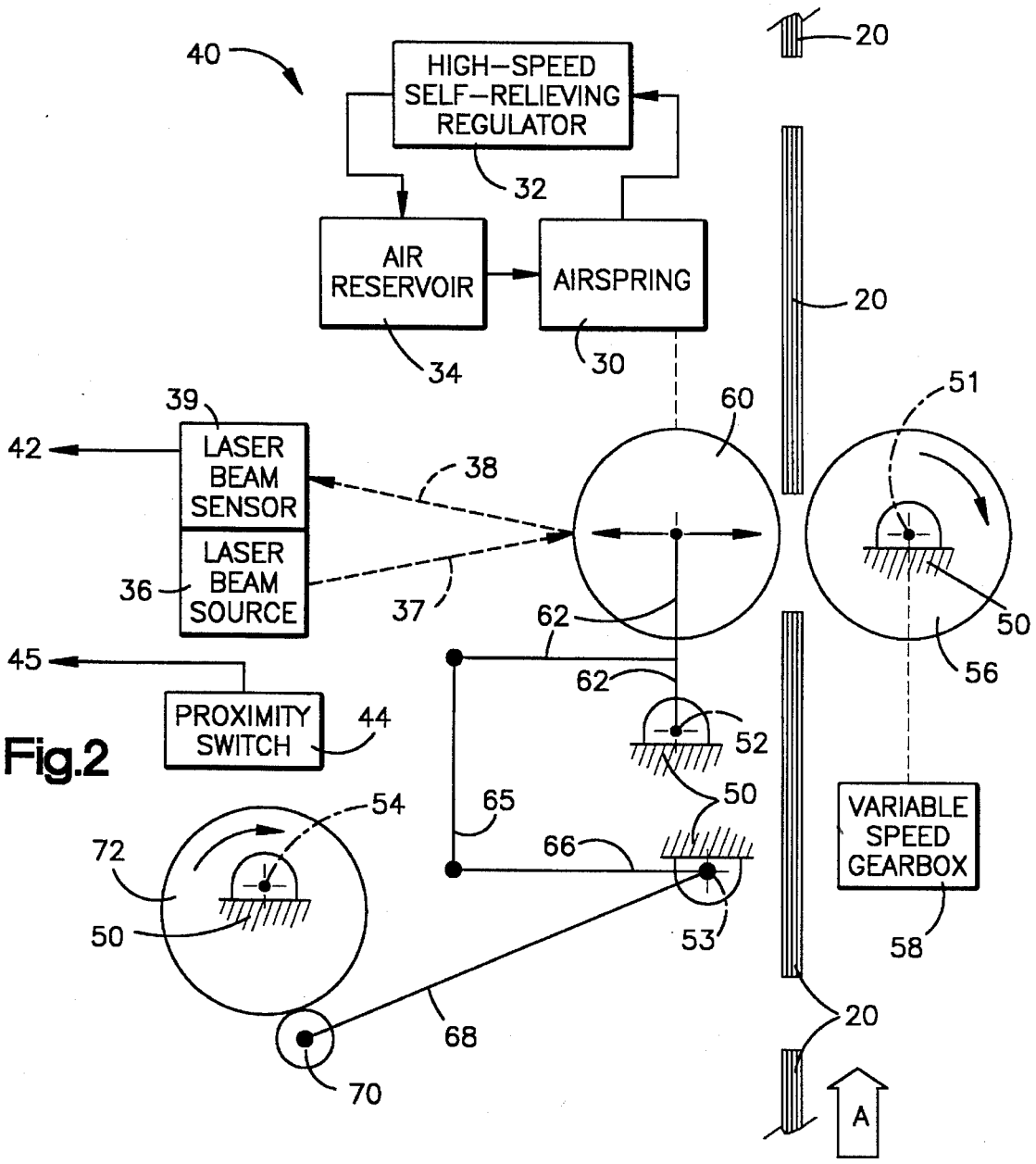
FIG. 2 is a schematic diagram of the calipering assembly of FIG. 1.

A calipering assembly 40 is disposed along the conveyor chain 14 for calipering each of the collated assemblages 20 to determine whether the page count of each collated assemblage is acceptable. The structure of the calipering assembly 40 is schematically illustrated in FIG. 2. The calipering assembly 40 comprises a frame 50 having a first bearing point 51, a second bearing point 52, a third bearing point 53, and a fourth bearing point 54. A wheel 56 is mounted for rotation about its own center axis and about a pivot pin at the first bearing point 51 on the frame 50. The center axis of the wheel 56 is fixed. A variable speed gear box 58 is drivingly connected to the wheel 56 to rotate the wheel 56 about its own center axis in a known manner. As shown in FIG. 2, the wheel 56 is driven to rotate in the clockwise direction. The structure and operation of variable speed gear boxes are known and, therefore, will not be described herein.

A movable wheel 60 in the form of a solid steel shaft is spaced apart from the wheel 56. The movable wheel 60 is free to rotate about its own center axis and is movable toward and away from the wheel 56. The movable wheel 60 is mounted for rotation about its own center axis and is mechanically coupled through a link arrangement 62 to a pivot pin at the second bearing point 52. One end of a tie bar 65 is attached by a pivot pin to the link arrangement 62, as schematically shown in FIG. 2. The opposite end of the tie bar 65 is attached by a pivot pin to one end of a link member 66. The other end of the link member 66 is clamped to a pivot shaft at the third bearing point 53 such that the link member 66 can pivot about the axis of the pivot shaft at the third bearing point 53 upon rotation of the pivot shaft.

One end of a cam lever arm 68 is also clamped to the pivot shaft at the third bearing point 53. The cam lever arm 68 is thus also pivotable about the axis of the pivot shaft at the third bearing point 53. The position of the cam lever arm 68 and the position of the link member 66 may be adjusted relative to each other by adjusting the clamps (not shown) which clamp the cam lever arm 68 and the link member 66 to the pivot shaft at the third bearing point 53.

When the cam lever arm 68 and the link member 66 are clamped to the pivot shaft at the third bearing point 53, the cam lever arm 68, the link member 66, and the pivot shaft are pivotable as a unit about the axis of the pivot shaft at the third bearing point 53. The movable wheel 60 moves either toward or away from the fixed wheel 56 depending upon the direction of the pivotal movement of the cam lever arm 68 and the link member 66 about the axis of the pivot shaft at the third bearing point 53.

The other end of the cam lever arm 68 is connected to a cam follower 70 which comprises a roller which rotates relative to the cam lever arm 68. A cam 72 is mounted for rotation about the axis of a shaft at the fourth bearing point 54 on the frame 50 in a clockwise direction, as illustrated in FIG. 2. The cam 72 has high and low spots about its periphery. The cam 72 controls the position of the cam follower 70 in accordance with the high and low spots on the cam 72.

When a high spot on the cam 72 engages the cam follower 70, the cam lever arm 68 pivots about the axis of the pivot shaft at the third bearing point 53 in a direction which, in turn, causes the link member 66 to pivot about the axis of the pivot shaft at the third bearing point 53. This pivoting of the link member 66 causes the tie bar 65 and the link arrangement 62 to pivot as a unit about the axis of the pivot pin at the second bearing point 52 in one direction. The unit pivots about the axis of the pivot pin at the second bearing point 52 in a direction such that the movable wheel 60 moves away from the wheel 56.

When the low spot on the cam 72 engages the cam follower 70, the cam lever arm 68 pivots about the axis of the pivot shaft at the third bearing point 53 in a direction which, in turn, causes the link member 66 to pivot about the axis of the pivot shaft at the third bearing point 53. The tie bar 65 and the link arrangement 62 then pivot as a unit about the pivot pin at the second bearing point 52 in a direction such that the movable wheel 60 moves toward the wheel 56.

Figure 3:
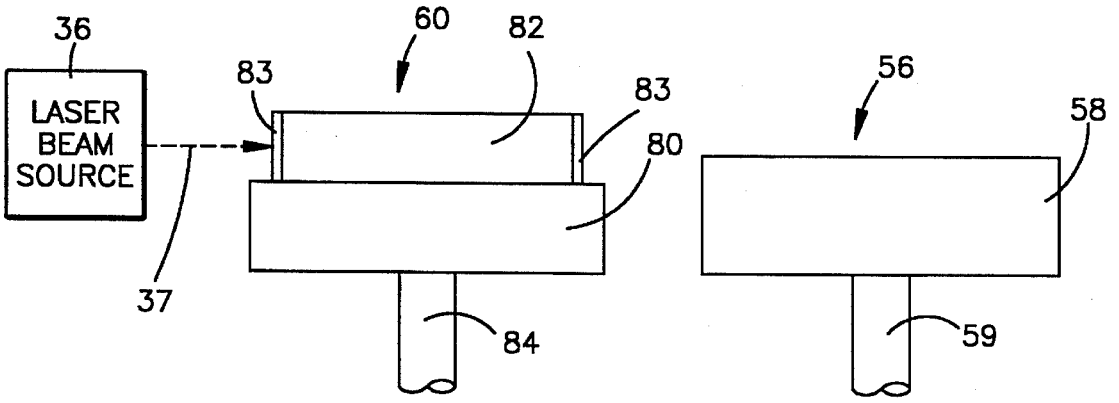
FIG. 3 is an elevational view of wheel members used in the calipering assembly of FIG. 2.

Referring to FIG. 3, the structure of the wheel 56 and the structure of the movable wheel 60 are schematically illustrated. The wheel 56 has a wheel portion 58 and a shaft portion 59. The movable wheel 60 comprises a larger diameter wheel portion 80 interconnecting a smaller diameter wheel portion 82 and a shaft portion 84. The smaller diameter wheel portion 82 has a smaller diameter than the larger diameter wheel portion 80 and, therefore, does not contact a collated assemblage being measured when the movable wheel 60 is moved into engagement with the collated assemblage being measured. Since the smaller diameter wheel portion 82 does not contact a collated assemblage being measured, ink from the collated assemblage will not build up on the smaller diameter wheel portion 82.

The smaller diameter wheel portion 82 serves as a light target for a source of light and is coated on its outer surface with a coating 83 to minimize spurious light reflections. The coating 83 comprises a ceramic material which is applied to the outer surface of the smaller diameter wheel portion 82 via a plasma spraying process. The ceramic material may be a powder which is melted and then sprayed onto the outer surface of the smaller diameter wheel portion 82. Preferably, the powder is APS 1001 alumina manufactured by APS Materials, Inc. of Dayton, Ohio.

After the sprayed material dries, the rough surface of the dried material is ground to a smooth finish to provide the coating 83. Preferably, the smooth finish of the coating 83 has a roughness average of no greater than 32 microinches as governed by the standard ANSI B46.1-1978. The outer surface of the coating 83 is axially adjacent the outer surface of the larger diameter wheel portion 80, as shown in FIG. 3.

An air spring 30 is located adjacent the movable wheel 60. The air spring 30 is controlled to apply a force to the movable wheel 60. The force is applied to urge the movable wheel 60 in a direction which presses the movable wheel 60 against the collated assemblage being measured to remove air from the collated assemblage and to press the pages of the collated assemblage together before a measurement is made.

A high speed self-relieving regulator 32 and air reservoir 34 controls the air supply to the air spring 30. The regulator 32 and air reservoir 34 maintain a constant pressure in the air spring 30, thereby maintaining a consistent force applied to a collated assemblage passing between the wheel 56 and the movable wheel 60. By applying a consistent force to a collated assemblage being measured, consistent measurements are obtainable. The force applied against a collated assemblage being measured can be adjusted on the fly by simply increasing or decreasing the pressure in the air spring 30 by operating the regulator 32 accordingly.

Further, the air spring 30 provides vibration damping characteristics which take effect at operating speeds above 250 cycles per minute. This eliminates the need for additional mechanical hardware to counter vibration when the calipering assembly 40 operates at such higher speeds.

Referring to FIGS. 2 and 3, a source of light 36 in the form of a laser beam source provides a laser beam 37 which is directed at the coated surface 83 of the smaller diameter wheel portion 82 of the movable wheel 60. The laser beam 37 is preferably continuously on. The laser beam 37 is reflected from the coated surface 83 of the smaller diameter wheel portion 82 of the movable wheel 60. The reflected laser beam is designated with reference numeral 38. As mentioned hereinabove, the coated surface 83 of the smaller diameter wheel portion 82 serves to minimize spurious light reflections.

A sensor 39 in the form of a laser beam sensor receives the reflected laser beam 38. The laser beam sensor 39 includes a sample and hold circuit (not shown) which is triggered in response to a trigger signal on line 45 from a proximity switch 44 located in the vicinity of the cam 72. The proximity switch 44 is operatively coupled with the cam 72 such that the proximity switch 44 provides the trigger signal on line 45 when the low spot on the cam 72 engages the cam follower 70. Thus, the trigger signal on line 45 is provided when the movable wheel 60 is moved toward the wheel 56 to engage a collated assemblage passing between the movable wheel 60 and the wheel 56.

When the trigger signal on line 45 is applied to the sample and hold circuit of the laser beam sensor 39, a characteristic of the reflected laser beam 38 is measured. This characteristic of the reflected laser beam 38 varies as a function of the thickness of the collated assemblage being measured and is, preferably, proportional to the thickness of the collated assemblage being measured. The characteristic of the reflected laser beam 38 may be, for example, its measured position of return in the laser beam sensor 39. The angle of the laser beam 37 with respect to the reflected laser beam 38 is fixed and known. This positional information would be a function of the thickness of the collated assemblage being measured. The laser beam sensor 39 further includes processing circuitry (not shown) which generates and provides the thickness signal on line 42 in response to the characteristic of the reflected laser beam 38 being measured.

As shown in FIG. 1, the thickness signal on line 42 from the calipering assembly 40 is directed to an electric circuit 90 for further processing. The signal on line 42 is an analog type of signal. The signal on line 42 is indicative of the thickness of a collated assemblage passing through the calipering assembly 40. Also, the trigger signal on line 45 from the calipering assembly 40 is directed to the electric circuit 90. The signal on line 45 is a digital type of signal. The electric circuit 90 receives the thickness signal on line 42 and the trigger signal on line 45 and processes the signals on lines 42, 45 to provide either a "BOOK OVER" signal on line 96 or a "BOOK UNDER" signal on line 97. Each of the signals on lines 96, 97 is a digital type of signal.

Figure 4:
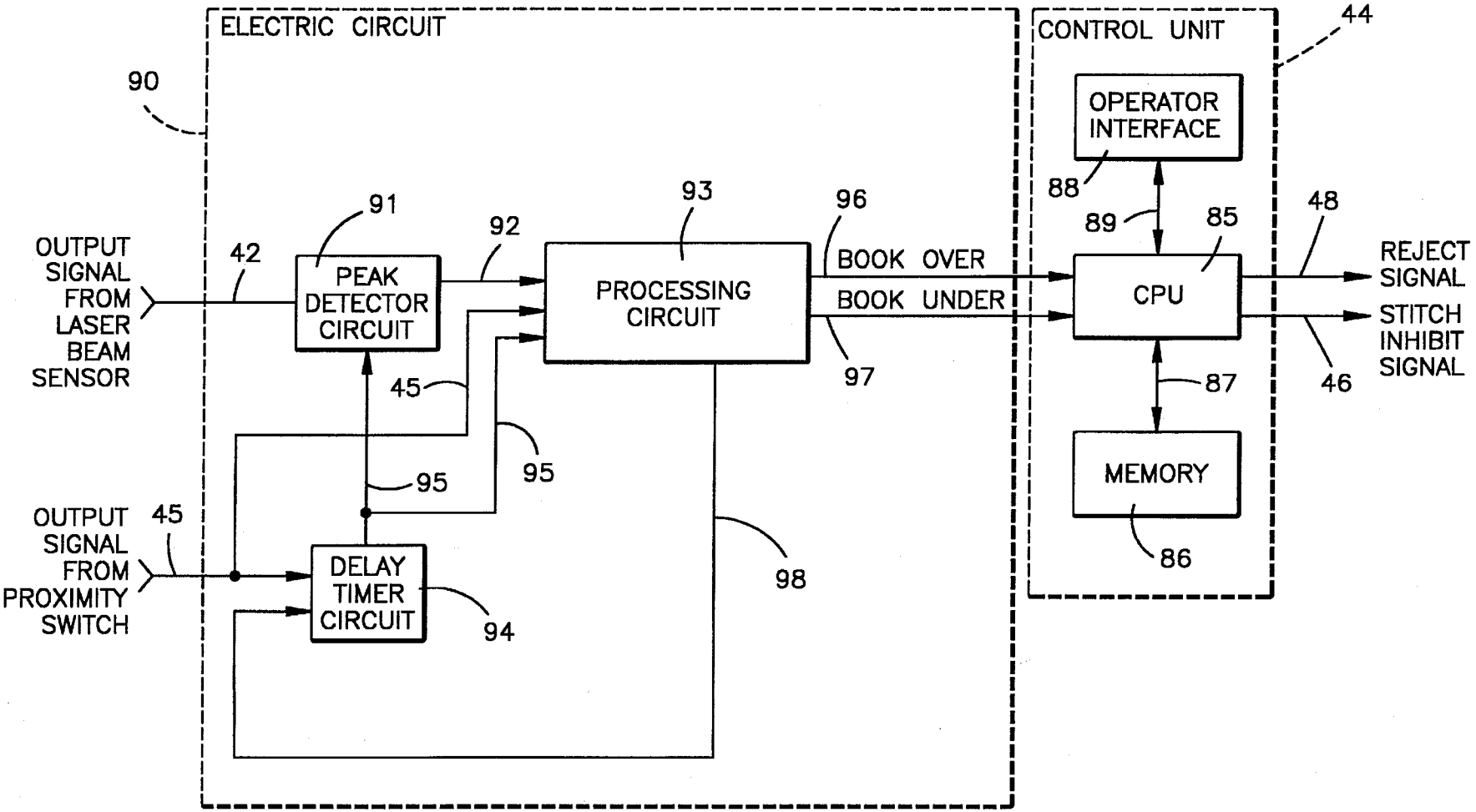
FIG. 4 is an enlarged detail view of a portion of FIG. 1.

Referring to FIG. 4, the electric circuit 90 includes a peak detector circuit 91 which receives the signal on line 42 and a delay timer circuit 94 which receives the signal on line 45. The peak detector circuit 91 generates an analog output signal on line 92 which varies as a function of the signal on line 42 from the laser beam sensor 39. A processing circuit 93 receives the signal on line 92 from the peak detector circuit 91 and the signal on line 45 from the proximity switch 44 and processes these signals to provide either the "BOOK OVER" on line 96 or the "BOOK UNDER" signal on line 97. The processing circuit 93 is, preferably, an intelligent analog signal conditioner/indicator module, such as Model 4062-XC1 manufactured by Daytronics, Inc.

The processing circuit 93 also generates a digital output signal on line 98 which is received by the delay timer circuit 94. The delay timer circuit 94 processes the signal on line 98 from the processing circuit 93 and the signal on line 45 from the proximity switch 44 to provide a reset signal on line 95. The reset signal on line 95 is applied to the peak detector circuit 91 and the processing circuit 93.

Specifically, the peak detector circuit 91 monitors the signal on line 42 from the laser beam sensor 39 and captures a maximum value of the signal on line 42. Typically, the peak detector circuit 91 includes a capacitor (not shown) which holds a charge corresponding to the maximum value of the signal on line 42. The processing circuit 93 monitors the signal on line 92 by sampling the signal on line 92 and stores the discrete sampled values in a memory (not shown) located in the processing circuit 93. The processing circuit 93 is then triggered at a first predetermined time to retrieve the largest sampled value stored in the memory of the processing circuit 93. The processing circuit 93 compares the retrieved largest sampled value with at least one predetermined stored value to determine if the retrieved largest sampled value is outside a predetermined value range.

The processing circuit 93 provides either the "BOOK OVER" signal on line 96 or the "BOOK UNDER" signal on line 97 if the largest sampled value is outside the predetermined thickness value range. For example, the processing unit 93 may provide either (i) the "BOOK OVER" signal on line 96 if the retrieved largest sampled value is higher than the highest value of the predetermined thickness value range, or (ii) the "BOOK UNDER" signal on line 97 if the retrieved largest sampled value is lower than the lowest value of the predetermined thickness value range. The range of acceptability is manually adjustable and can be displayed in the form of a bar graph display in the plus and/or negative direction. The delay timer circuit 94 applies the reset signal on line 95 to the peak detector circuit 91 and the processing circuit 93 at a second predetermined time which is later than the first predetermined time to (i) clear the value held on line 92 from the peak detector circuit 91, and (ii) clear the values which were sampled and stored in the memory of the processing circuit 93.

The cooperation of the three circuits 91, 93, 94 to provide either the "BOOK OVER" signal on line 96 or the "BOOK UNDER" signal on line 97 as a function of the signals on lines 42, 45 from the laser beam sensor 39 and the proximity switch 44 is better explained with reference to the graphical illustration of various output signals in FIG. 5.

The signal on line 42 is the output signal from the laser beam sensor 39. The signal on line 92 is the output signal from the peak detector circuit 91. The signal on dotted line 92' is the series of discrete signals which have been sampled by the processing circuit 93, digitized, and stored in a memory of the processing circuit 93. The signal on line 45 is the output signal from the proximity switch 44. The signal on line 95 is the output signal from the delay timer circuit 94.

Figure 5:
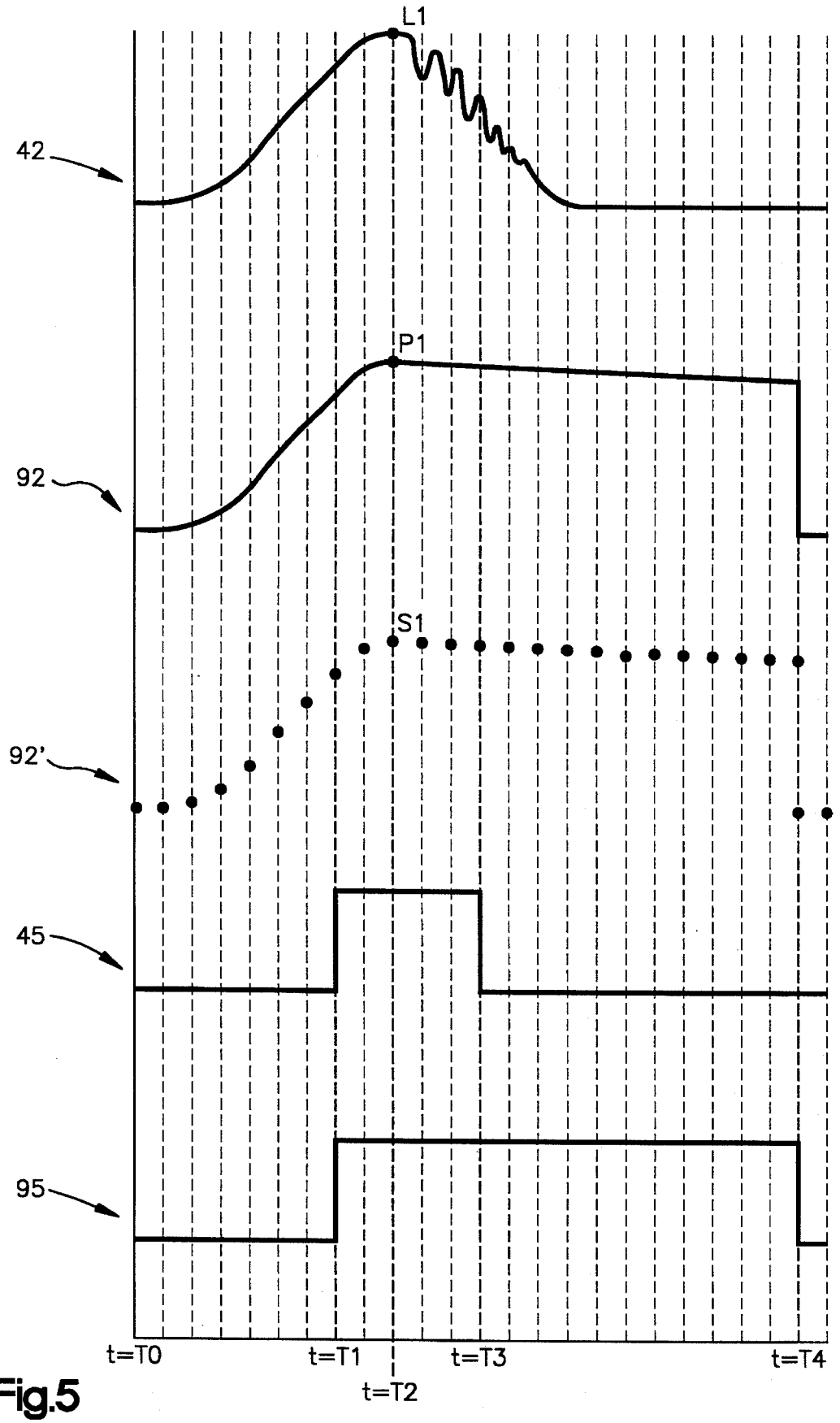
FIG. 5 is a graphical illustration of various output signals.

At time t=TO depicted in FIG. 5, the movable wheel 60 begins to compress the collated assemblage to be measured against the wheel 56. As the collated assemblage is being compressed, the signal on line 42 from the laser beam sensor 39 increases. At the same time, the signal on line 92 from the peak detector circuit 91 increases. As previously stated, the processing circuit 93 samples the signal on line 92 and stores the discrete sampled values in a memory located in the processing circuit 93. The series of discrete sampled values on dotted line 92' corresponds to values of the signal on line 92 at a series of points in time.

When the collated assemblage being compressed is at its maximum compressed condition between the movable wheel 60 and the wheel 56, the signal on line 42 from the laser beam sensor 39 is at a maximum value of L1 at time t=T2. Accordingly, the signal on line 92 from the peak detector circuit 91 is at a maximum value of P1 at time t=T2. Also, the sampled value of the signal on line 92 is at a maximum value of S1 at time t=T2.

During the time period between time t=T3 and t=T4, the movable wheel 60 moves away from the wheel 56. The effects of mechanical vibration on the signal on line 42 from the laser beam sensor 39 are depicted between time t=T2 and t=T3. As depicted between time t=T2 and t=T3, the signal on line 92 from the peak detector circuit 91 is unaffected by the effects of mechanical vibration on the signal on line 42 from the laser beam sensor 39. The value of the signal on line 92 at time t=T3 remains at substantially the peak value of P1 which was detected at time t=T2. Accordingly, the discrete sampled value of the signal on dotted line 92' at time t=T3 is at about the same discrete peak value of S1 which was obtained and stored at time t=T2.

As depicted in FIG. 5, there is a small gradual decay of the signal on line 92 from its peak value of P1 between time t=T2 and time t=T4. The signal on line 92 gradually decays because of the leak characteristics of the capacitor in the peak detector circuit 91. Accordingly, the discrete sampled values of the signal on dotted line 92' gradually decrease as depicted between time t=T2 and t=T4.

At time t=T3, the collated assemblage is no longer compressed between the movable wheel 60 and the wheel 56. At the same time, the signal on line 92 from the peak detector circuit 91 is at a value slightly less than the peak value which was at time t=T2. Also, at time t=T3, the discrete sampled value of the signal on dotted line 92' is at a value slightly less than the discrete peak value which was obtained and stored in the memory of the processing circuit 93 at time t=T2.

As depicted at time t=T1, the signal on line 45 from the proximity switch 44 rises from a low level to a high level to provide a first triggering signal. At the same time, the reset signal on line 95 from the delay timer circuit 94 also rises from a low level to a high level. The signal on line 95 enables the peak detector circuit 91 to capture peaks between time t=T1 and time t=T4. When the first triggering signal is provided on line 45, the "BOOK OVER" signal on line 96 and the "BOOK UNDER" signal on line 97 from the processing circuit 93 are cleared. Between time t=T3 and t=T4, the value of the signal on line 92 continues to decay and the discrete sampled values of the signal on dotted line 92' continue to decrease.

At time t=T3, the signal on line 45 from the proximity switch 44 falls from the high level back down to the low level to provide a second triggering signal. When the second triggering signal is provided at time t=T3, the processing circuit 93 searches its memory and retrieves the largest sampled value of the signal on dotted line 92' and stored in the memory of the processing circuit 93 since time t=T1. In the example depicted in FIG. 5, the discrete sampled value of S1 (which was sampled at time t=T2) is the largest sampled value of the signal on dotted line 92' and stored in the memory of the processing circuit 93 since time t=T1. The processing circuit 93 then takes the value of S1 and compares it with at least one predetermined stored value in the memory of the processing circuit 93 to determine if the value of S1 is outside a predetermined value range. The processing circuit 93 provides either the "BOOK OVER" signal on line 96 or the "BOOK UNDER" signal on line 97 if the value of S1 outside the predetermined value range, as already described hereinabove.

After a time delay of about 60 milliseconds from time t=T3 to t=T4 as depicted in FIG. 5, the signal on line 95 from the delay timer circuit 94 falls from the high level to the low level to provide a third triggering signal. When the third triggering signal is provided on line 95, the value held on line 92 from the peak detector circuit 91 is cleared. Also, the discrete sample of the signal on line 92' and stored in the memory of the processing circuit are cleared. After time t=T4, the cycle described hereinabove is repeated to determine whether the page count of the next collated assemblage is within an acceptable value range.

Referring again to FIGS. 1 and 4, a control unit 44 monitors the signals on lines 96, 97 and processes the signal on line 96 or the signal on line 97 to determine whether the page count of the collated assemblage passing through the calipering assembly 40 is acceptable. The control unit 44 includes a central processing unit 85 such as a microcomputer. The microcomputer 85 communicates via line 87 with an external memory 86 and via line 89 with an operator interface 88 such as a keyboard and/or video display.

Specifically, the microcomputer 85 monitors the signal on line 96 and the signal on line 97 from the electric circuit 90. The microcomputer 85 determines whether the page count of the collated assemblage passing through the calipering assembly 40 is acceptable by comparing either the value of the signal on line 96 or the value of the signal on line 97 with a known value stored in the memory 86 of the control unit 44. If the value of the signal on line 96 or the value of the signal on line 97 is within an acceptable range of the value stored in the memory 86, the collated assemblage being measured is deemed to have the correct number of pages and, therefore, a good product. If the value of the signal on line 96 or the value of the signal on line 97 is not within the acceptable range of the value stored in the memory 86, the collated assembly being measured is deemed to have an incorrect number of pages and, therefore, a bad product. The range of acceptability is manually selectable.

When a collated assemblage passing through the calipering assembly 40 is found to have less than the required number of pages, or an excess number of pages, or other measured abnormality, on the basis of the value of the signal on line 96 or the value of the signal on line 97, the microcomputer 85 identifies the collated assemblage as unacceptable and generates a stitcher inhibit signal on line 46 which is applied to the stitcher 22. The microcomputer 85 includes a shift register which delays the generation of the stitch inhibit signal on line 46 subsequent to detection of the unacceptable collated assemblage until that particular collated assemblage is positioned along the collating line 10 opposite the stitcher 22. Accordingly, the stitch inhibit signal on line 46 prevents the operation of the stitcher 22 for that particular collated assemblage.

After the microcomputer 85 generates the stitch inhibit signal on line 46, the microcomputer 85 generates a reject signal on line 48 which is applied to the ejector 24. Another shift register of the microcomputer 85 delays the generation of the reject signal on line 48 for a predetermined time period subsequent to the generation of the stitch inhibit signal on line 46. The generation of the reject signal on line 48 is delayed until the unacceptable collated assemblage is positioned along the collating line 10 opposite the ejector 24. Accordingly, the reject signal on line 48 actuates the ejector 24 to eject the unacceptable collated assemblage from the conveyor chain 14.

A number of advantages result by providing the calipering assembly 40 including the laser beam source 36 and the laser beam sensor 39 according to the present invention. One advantage is that a high resolution of a measured distance value corresponding to the thickness of a collated assemblage being measured is obtained. A high resolution is obtained because the laser beam sensor 39 is able to read and process the measured distance value without any magnification. Since no magnification of the measured distance value is required, no error due to magnification is introduced. Another advantage is that only minimal mechanical set up of the sensor portion of the calipering assembly 40 is required.

Still another advantage is that the effects of mechanical vibration on the output signal on line 42 from the laser beam sensor 39 are reduced. Mechanical vibration may be present if the saddle binding line 10 is operating at relatively high speed. If mechanical vibration is present, the movable wheel 60 may vibrate as it compresses the collated assemblage being measured against the wheel 56. This would cause the signal on line 42 from the laser beam sensor 39 to vary according to the mechanical vibration acting on the movable wheel 60. However, since the three circuits 91, 93, 94 cooperate to capture and process the largest value of the signal on line 42 (corresponding to the most compressed condition of the collated assemblage being measured), the effects of mechanical vibration on the signal on line 42 are significantly reduced.

From the above description of the invention, those skilled in the art to which the present invention relates will perceive improvements, changes and modifications. Such improvements, changes and modifications within the skill of the art to which the present invention relates are intended to be covered by the appended claims.

Having described the invention, the following is claimed:

1. An apparatus for use along a collating conveyor having collated assemblages thereon, said apparatus comprising:

means for forming a collated assemblage on the collating conveyor;

compressing means for compressing the collated assemblage;

sensing means for sensing the thickness of a compressed collated assemblage and for providing a first electrical signal which varies as a function of the thickness of the compressed collated assemblage; and circuit means for (i) detecting a value of said first electrical signal corresponding to a maximum compressed condition of the collated assemblage, (ii) holding said value for at least a predetermined time period, and (iii) providing a second electrical signal indicative of whether said value of said first electrical signal is within a predetermined value range.

2. An apparatus according to claim 1 wherein said compressing means comprises first and second wheel members and means for supporting said second wheel member for movement toward said first wheel member to compress a collated assemblage between said first and second wheel members as the collating conveyor moves the collated assemblage between said first and second wheel members.

3. An apparatus according to claim 2 wherein said sensing means comprises (i) a light source for directing light toward said second wheel member and (ii) a light sensor for receiving reflected light from said second wheel member to produce said first electrical signal which varies as a function of the thickness of the compressed collated assemblage.

4. An apparatus according to claim 1 wherein said circuit means includes a peak detector circuit for detecting the largest peak value of said first electrical signal which corresponds to the maximum compressed condition of the collated assemblage.

5. An apparatus according to claim 4 wherein said circuit means includes a delay timer circuit for enabling said peak detector circuit to hold said largest positive value of said first electrical signal for at least said predetermined time period.

6. An apparatus according to claim 5 wherein said delay timer circuit includes means for resetting said peak detector circuit after said peak detector circuit has held said largest positive value of said first electrical signal for at least said predetermined time period.

7. An apparatus for use along a collating conveyor having collated assemblages thereon, said apparatus comprising:

a movable member having an outer circumferential surface which engages a collated assemblage to compress the collated assemblage when said movable member is moved towards the collated assemblage;

a light source for directing a light beam toward said outer circumferential surface of said movable member;

said outer circumferential surface of said movable member including a light reflective surface portion against which said light beam is directed and then reflected, said reflected light beam having a characteristic which varies as a function of the thickness of the collated assemblage;

means for sensing said reflected light beam from said light reflective surface portion of said outer circumferential surface of said movable member;

means for providing a first electrical signal which varies as a function of said characteristic of said reflected light beam and thus as a function of the thickness of the collated assemblage;

circuit means for (i) detecting a value of said first electrical signal corresponding to a maximum compressed condition of the collated assemblage, (ii) holding said value for at least a predetermined time period, and (iii) providing a second electrical signal indicative of whether said value of said first electrical signal is within a predetermined value range.

8. An apparatus according to claim 7 wherein said outer circumferential surface of said movable member comprises a collated assemblage engaging surface portion and said light reflective surface portion, said light reflective surface portion having a diameter which is smaller than the diameter of said collated assemblage engaging surface portion.

9. An apparatus according to claim 7 wherein said light reflective surface portion includes a coating for minimizing spurious light reflections.

10. An apparatus according to claim 7 wherein said light source comprises means for providing a laser beam.

11. An apparatus according to claim 10 wherein said means for receiving said reflected light beam includes a laser beam sensor.

* * * * *